US010811801B2

(12) United States Patent
Pickel et al.

(10) Patent No.: US 10,811,801 B2
(45) Date of Patent: Oct. 20, 2020

(54) ELECTRICAL CONNECTOR WITH LOW INSERTION LOSS CONDUCTORS

(71) Applicant: TE CONNECTIVITY CORPORATION, Berwyn, PA (US)

(72) Inventors: Justin Dennis Pickel, Hummelstown, PA (US); John Joseph Consoli, Harrisburg, PA (US); Chad William Morgan, Carneys Point, NJ (US); Timothy Robert Minnick, Enola, PA (US); David Patrick Orris, Middletown, PA (US); Daniel Briner Shreffler, Mechanicsburg, PA (US); David Allison Trout, Lancaster, PA (US); Arturo Pachon Munoz, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/810,744

(22) Filed: Nov. 13, 2017

(65) Prior Publication Data

US 2019/0148862 A1 May 16, 2019

(51) Int. Cl.

| | |
|---|---|
| ***H01R 13/03*** | (2006.01) |
| ***H01R 12/71*** | (2011.01) |
| ***H01R 13/646*** | (2011.01) |
| ***H01R 13/6587*** | (2011.01) |

(52) U.S. Cl.

CPC ..... *H01R 13/03* (2013.01); *H01R 12/716* (2013.01); *H01R 13/646* (2013.01); *H01R 13/6587* (2013.01)

(58) Field of Classification Search

CPC ..... H01R 13/03; H01R 13/00; H01R 12/716; H01R 13/646; H01R 13/6587

See application file for complete search history.

(56) References Cited

U.S. PATENT DOCUMENTS

| | | | | |
|---|---|---|---|---|
| 3,494,998 | A * | 2/1970 | Anhalt | H01R 13/426 264/249 |
| 4,600,480 | A * | 7/1986 | Coombes | C23C 18/1603 205/136 |
| 5,028,492 | A * | 7/1991 | Guenin | C09D 5/24 428/614 |
| 5,141,702 | A * | 8/1992 | Guenin | C09D 5/24 156/242 |
| 5,235,743 | A * | 8/1993 | Endo | H01R 13/03 29/874 |
| 5,477,661 | A * | 12/1995 | Draghetti | B29C 65/7882 53/466 |
| 7,618,289 | B2 | 11/2009 | Rothermel et al. | |

(Continued)

*Primary Examiner* — Briggitte R. Hammond

(57) ABSTRACT

An electrical connector includes a housing and a plurality of conductors held within the housing. The conductors are configured to electrically connect to mating conductors of a mating connector. The conductors each extend a length between a mating end and a mounting end of the respective conductor. One or more of the conductors include a copper alloy core, a copper plating layer, and a protective outer layer. The copper plating layer surrounds the copper alloy core, and is composed of a different material than the copper alloy core. The protective outer layer is disposed on and surrounds the copper plating layer. The protective outer layer is composed of a non-conductive polymeric material.

20 Claims, 4 Drawing Sheets

(56) References Cited

U.S. PATENT DOCUMENTS

| | | | |
|---|---|---|---|
| 7,771,233 | B2 | 8/2010 | Gailus |
| 7,794,278 | B2 | 9/2010 | Cohen et al. |
| 8,177,926 | B2 | 5/2012 | Lacasse et al. |
| 8,262,412 | B1 | 9/2012 | Minnick et al. |
| 8,771,016 | B2 | 7/2014 | Atkinson et al. |
| 8,998,642 | B2 | 4/2015 | Manter et al. |
| 9,666,998 | B1 | 5/2017 | de Boer et al. |
| 9,859,640 | B1 | 1/2018 | Horning et al. |
| 2019/0036256 | A1 | 1/2019 | Martens et al. |

* cited by examiner

ELECTRICAL CONNECTOR WITH LOW INSERTION LOSS CONDUCTORS

BACKGROUND OF THE INVENTION

The subject matter herein relates generally to an electrical connector configured to transmit electrical signals with low insertion loss, and, more specifically, to an electrical connector with conductors designed to have lower conducting-surface losses at high signal transmission speeds relative to known conductors in electrical connectors.

Electrical connectors include terminals or conductors that provide conductive current paths through the connectors for interconnecting cables, circuit boards, or the like. Typical conductors are composed of a copper alloy core and have nickel plating surrounding the core to protect the core from corrosion. The specific metals within the copper alloy core may be selected based on various considerations, such as cost and material properties. For example, a conductor that includes a deflectable contact at a mating interface may have a copper alloy core that includes metals that provide a desired amount of flexibility and elasticity to the conductor.

Typical conductors in connectors have several disadvantages, however, especially at high signal transmission speeds above 10 Gb/s. Due to the phenomenon referred to as the skin effect, the current density of a signal transmitted along the conductors concentrates near the surface. The copper alloy core and the nickel plating at the surface of the typical conductors have relatively low electrical conductivities, so transmitted signals experience significant insertion losses along the conductors. The conductor-caused insertion losses are exacerbated at higher signal frequencies.

High speed and high signal density connectors provide the benefit of increased signal throughput, but the high insertion losses caused by the material properties of the typical conductors detract from this benefit by reducing the signal transmission efficiency and quality. A need remains for a high speed electrical connector with low insertion loss conductors.

BRIEF DESCRIPTION OF THE INVENTION

In one or more embodiments, an electrical connector is provided that includes a housing and a plurality of conductors held within the housing. The conductors are configured to electrically connect to mating conductors of a mating connector. The conductors each extend a length between a mating end and a mounting end of the respective conductor. One or more of the conductors include a copper alloy core, a copper plating layer, and a protective outer layer. The copper plating layer surrounds the copper alloy core, and is composed of a different material than the copper alloy core. The protective outer layer is disposed on and surrounds the copper plating layer. The protective outer layer is composed of a non-conductive polymeric material.

In one or more embodiments, an electrical connector is provided that includes a housing and a plurality of conductors held within the housing. The conductors are configured to electrically connect to mating conductors of a mating connector. The conductors each extend a length between a mating end and a mounting end of the respective conductor. The conductors each include a spring beam at the mating end, a contact tail at the mounting end, and an intermediate segment extending from the spring beam to the contact tail. One or more of the conductors include a copper alloy core, a copper plating layer, and a protective outer layer. The copper plating layer surrounds the copper alloy core. The copper plating layer is composed of a different material than the copper alloy core and has a greater electrical conductivity than the copper alloy core. The protective outer layer is disposed on and surrounds the copper plating layer. The protective outer layer is composed of a non-conductive polymeric material.

In one or more embodiments, an electrical connector is provided that includes a housing, a plurality of conductors held within the housing, and a dielectric body held within the housing. The conductors are configured to electrically connect to mating conductors of a mating connector. The conductors are arranged in at least one linear array. The conductors each extend a length between a mating end and a mounting end of the respective conductor. The conductors each include a spring beam at the mating end, a contact tail at the mounting end, and an intermediate segment extending from the spring beam to the contact tail. One or more of the conductors includes a copper alloy core and a protective outer layer surrounding the copper plating layer around a full perimeter of the copper alloy core. The protective outer layer is composed of a non-conductive polymeric material. The dielectric body encases the conductors of a common array along the intermediate segments thereof to secure the conductors in place relative to each other. The dielectric body engages the protective outer layer of the conductors.

DETAILED DESCRIPTION OF THE INVENTION

Figure 1:
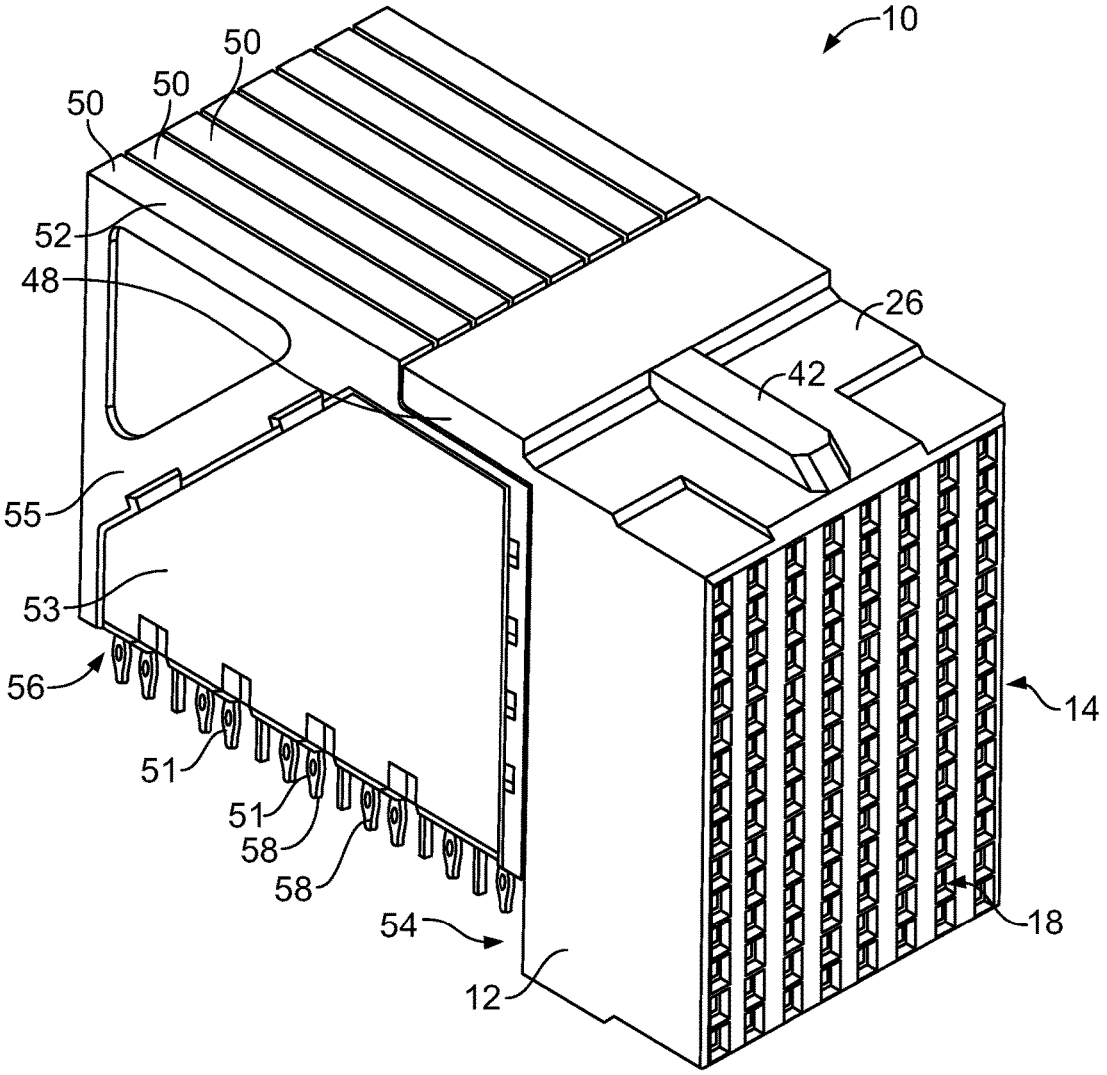
FIG. 1 is a perspective view of an electrical connector according to an embodiment.

FIG. 1 is a perspective view of an electrical connector 10 according to an embodiment. The illustrated electrical connector 10 is a receptacle connector that is configured to mate to a mating plug connector (not shown), but the electrical connector 10 in alternative embodiments may be a plug connector or a different type of electrical connector. The following description of the electrical connector 10 in FIG.

1 is therefore provided for illustration, rather than limitation, and is but one potential application of the inventive subject matter described herein.

The electrical connector 10 includes a housing 12 that has a mating end 14 and a back end 54. The housing 12 is composed of a dielectric material, such as one or more plastics or other polymeric materials. The housing 12 defines a plurality of contact cavities 18 at the mating end 14 that are configured to receive mating contacts (not shown) of the mating connector through the mating end 14. The housing 12 in the illustrated embodiment includes an alignment rib 42 along an upper surface 26 of the housing 12. The alignment rib 42 is configured to bring the connector 10 into alignment with the mating connector during the mating process to enable the mating contacts of the mating connector to be received into the corresponding contact cavities 18 without stubbing.

The housing 12 also includes a plurality of contact modules (e.g., contact module assemblies) 50 that are received in the housing 12 and extend from the back end 54 of the housing 12. The housing 12 holds the contact modules 50 in place relative to one another and to the housing 12. In the illustrated embodiment, the contact modules 50 engage a hood 48 of the housing 12 that extends rearward beyond the back end 54. The contact modules 50 are stacked side-by-side. The contact modules 50 collectively define a mounting end 56 of the electrical connector 10. Each of the contact modules 50 includes plural conductors 51 and a dielectric body 52. The dielectric bodies 52 define a mounting end 56 of the electrical connector 10. The contact modules 50 also may include conductive shields 53 mounted to sides 55 of the dielectric bodies 52 to provide shielding for the conductors 51.

The conductors 51 include contact tails 58 that protrude beyond the dielectric bodies 52 at the mounting end 56. The contact tails 58 are configured to be mounted to and electrically connected to a substrate (not shown), such as a printed circuit board. The contact tails 58 are illustrated as, but are not limited to, eye-of-the-needle-type pin contacts. The conductors 51 of the contact modules 50 also include mating contact portions 34 (shown in FIG. 2) that are received within the contact cavities 18 of the housing 12. The mating contact portions 34 are configured to engage and electrically connect to the mating contacts of the mating connector.

In the illustrated embodiment, the electrical connector 10 is a right angle connector as the mounting end 56 is oriented substantially perpendicular to the mating end 14 of the housing 12. The electrical connector 10 is configured to interconnect electrical components, such as a backplane circuit board and a daughter circuit board, that are disposed at a right angle relative to one another. In an alternative embodiment, the electrical connector 10 may have a different orientation. For example, the connector 10 may be an in-line connector that extends linearly between the mating end 14 and the mounting end 56, with the mating end 14 oriented substantially parallel to the mounting end 56.

Figure 2:
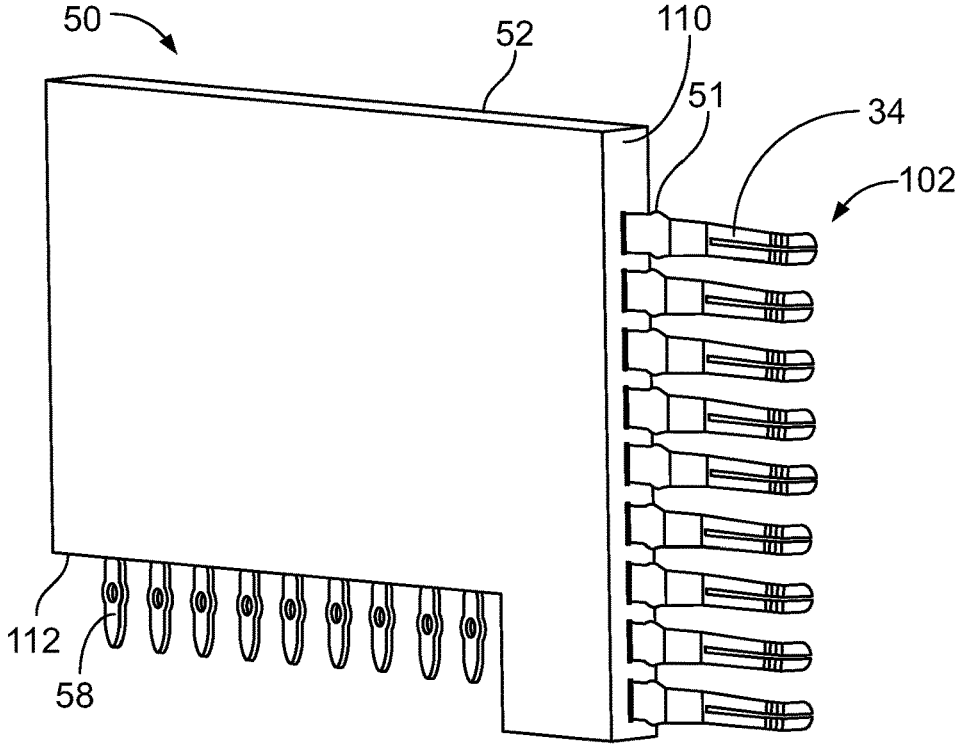
FIG. 2 is a side perspective view of one of the contact modules of the electrical connector of FIG. 1 according to an embodiment.
Figure 3:
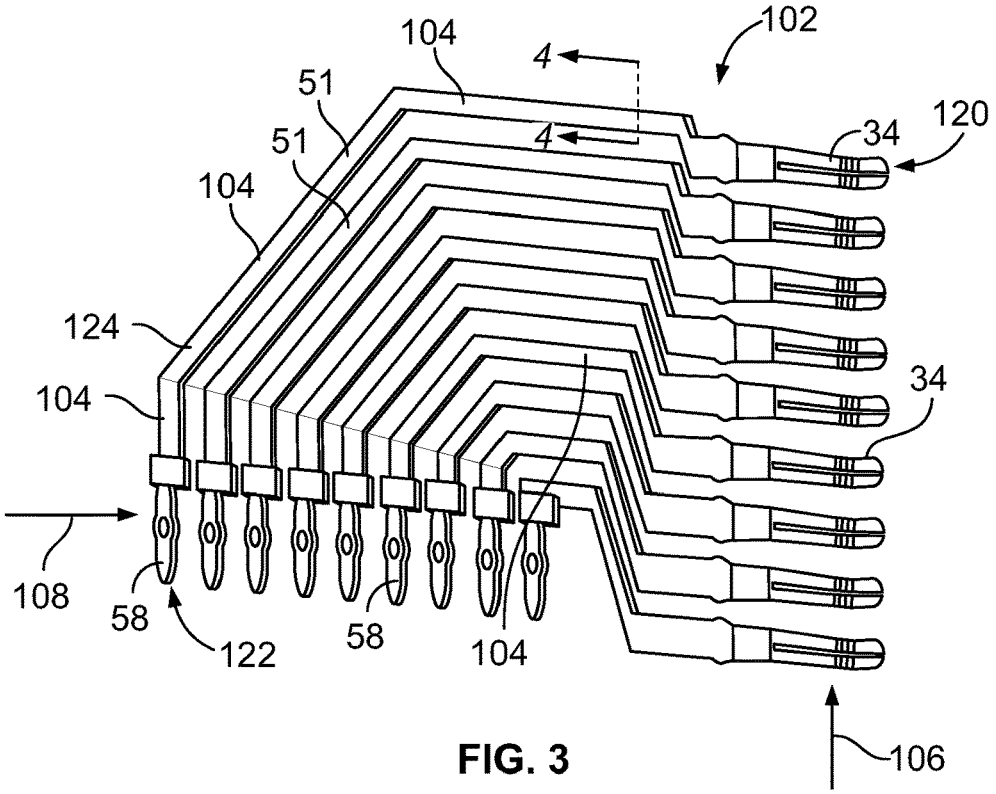
FIG. 3 is a side perspective view of an array of conductors of the contact module shown in FIG. 2 according to an embodiment.

FIG. 2 is a side perspective view of one of the contact modules 50 of the electrical connector 10 of FIG. 1 according to an embodiment. The contact module 50 includes a plurality of conductors (or terminals) 51 held by the dielectric body 52. The conductors 51 are arranged in a linear array 102. FIG. 3 is a side perspective view of the array 102 of conductors 51 of the contact module 50 according to an embodiment. FIG. 3 shows the contact module 50 without the dielectric body 52.

Referring to FIG. 3, the conductors 51 in the linear array 102 are oriented along a vertical plane. The array 102 of conductors 51 may be referred to herein as a lead frame. Each of the conductors 51 includes a mating contact portion 34, a contact tail 58, and an intermediate segment 104 of the conductor 51 extending from the mating contact portion 34 to the contact tail 58. The mating contact portion 34 defines a mating end 120 of the conductor 51, and the contact tail 58 defines a mounting (or terminating) end 122 of the conductor 51. Each conductor 51 extends continuously from the mating end 120 to the mounting end 122, providing a conductive signal path between the two ends 120, 122.

The mating contact portions 34 in the illustrated embodiment are each oriented horizontally. Adjacent mating contact portions 34 are stacked vertically in a column 106. The contact tails 58 in the illustrated embodiment are each oriented vertically. Adjacent contact tails 58 are stacked laterally side-by-side in a row 108. The row 108 is substantially perpendicular to the column 106. Thus, the mating contact portions 34 extend substantially perpendicular to the contact tails 58. The intermediate segments 104 of the conductors 51 extend along predetermined paths between the mating contact portions 34 and the contact tails 58. The paths may include oblique sections 124 that extend at approximately 45 degree angles between the respective mating contact portion 34 and contact tail 58. The intermediate segments 104 of different conductors 51 may extend different lengths depending on the locations of the mating contact portions 34 and the contact tails 58 in the array 102. In an alternative embodiment, the mating contact portions 34 may be arranged parallel to the contact tails 58.

Each of the conductors 51 may be individually designated as a signal conductor, a ground conductor, or a power conductor. The array 102 may include any number of conductors 51, any number of which may be selected as signal, ground, or power conductors according a desired wiring pattern. Optionally, adjacent signal conductors may function as differential pairs configured to convey electrical signals at speeds greater than 10 Gb/s. Each differential pair may be separated from an adjacent differential pair by at least one conductor 51 designated as a ground conductor.

Referring back to FIG. 2, the dielectric body 52 of the contact module 50 encases the conductors 51 of the array 102 to secure the conductors 51 in place relative to one another (and relative to the housing 12 shown in FIG. 1). For example, the dielectric body 52 maintains a space between each of the conductors 51 to prevent shorting of the conductors 51. The dielectric body 52 surrounds and engages the intermediate segments 104 (FIG. 3) of the conductors 51. The dielectric body 52 includes a mating edge 110 and a mounting edge 112. The mating contact portions 34 of the conductors 51 protrude from the mating edge 110, and the contact tails 58 protrude from the mounting edge 112.

In an embodiment, the dielectric body 52 is formed via an overmold process. For example, a heated, non-conductive polymeric material in a flowable state is applied onto the array 102 of conductors 51 and allowed to cool and set, encasing the intermediate segments 104 of the conductors 51 in the resulting solid dielectric body 52. Prior to the overmold process, the conductors 51 may be held together using a carrier strip that is subsequently removed and discarded after the overmold process. In other embodiments, the dielectric body 52 may be a pre-formed single frame (or multiple frame members) into which the conductors 51 are inserted and held via an interference fit, a latching connection, an adhesive bond, or the like.

In the illustrated embodiment, the mating contact portions 34 of the conductors 51 are spring beams 34. With additional reference to FIG. 1, when the contact module 50 is loaded into the connector 10, the spring beams 34 are received in the corresponding contact cavities 18 of the housing 12 through the back end 54. The spring beams 34 are resiliently deflectable, and are configured to deflect when the mating contacts of the mating connector enter the contact cavities 18 through the mating end 14 and engage the spring beams 34. When deflected, the spring beams 34 are biased towards the non-deflected resting positions shown in FIGS. 2 and 3, so the spring beams 34 exert a contact force on the mating contacts. The contact force maintains the electrical connection between the spring beams 34 and the mating contacts. The mating contact portions 34 are not limited to spring beams, and may have other forms in other embodiments, such as pins, sockets, blades, or the like. Similarly, the contact tails 58 may be other than eye-of-the-needle-type pins in one or more alternative embodiments, such as solder tails configured for surface terminations.

Figure 4:
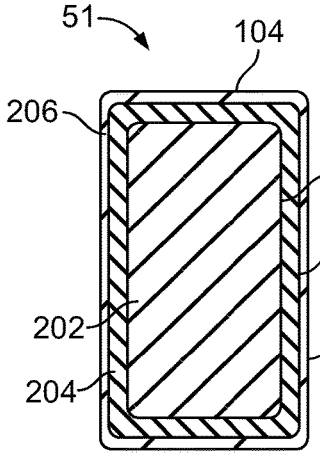
FIG. 4 is a transverse cross-sectional view of one of the conductors along an intermediate segment according to a first embodiment.
Figure 5:
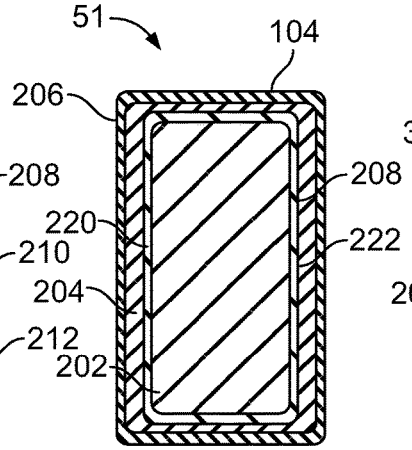
FIG. 5 is a transverse cross-sectional view of one of the conductors along an intermediate segment according to a second embodiment.
Figure 6:
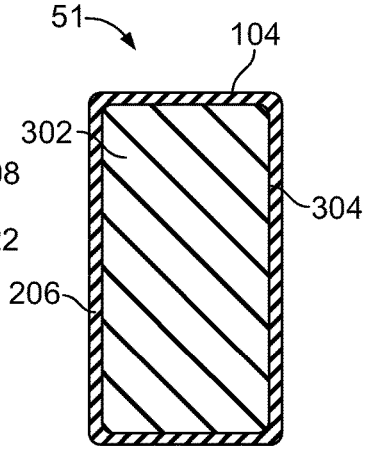
FIG. 6 is a transverse cross-sectional view of one of the conductors along an intermediate segment according to a third embodiment.

FIGS. 4-6 are transverse cross-sectional views of one of the conductors 51 of the electrical connector 10 (shown in FIG. 1) taken along the line 4-4 shown in FIG. 3 according to three different embodiments of the present disclosure. As shown in FIG. 3, the line 4-4 extends through the intermediate segment 104 of the conductor 51.

FIG. 4 shows a cross-sectional view of the intermediate segment 104 of the conductor 51 according to a first embodiment. The conductor 51 includes a copper alloy core 202 and a copper plating layer 204 that surrounds the copper alloy core 202 (also referred to herein as core 202). The conductor 51 also includes a protective outer layer 206 that surrounds the copper plating layer 204.

The copper alloy core 202 and the copper plating layer 204 are composed of different materials. The copper plating layer 204 has a greater electrical conductivity than the core 202 due to the material properties of the different materials. For example, the copper plating layer 204 may include a greater amount or percentage of copper present per weight or mass than the copper alloy core 202. The copper plating layer 204 may have a greater % IACS value than the copper alloy core 202. As used herein, "% IACS" values refer to a unit of the International Annealed Copper Standard (IACS), which is an empirically derived standard value for the electrical conductivity of copper. A material with a value of 10% IACS means that the electrical conductivity of that material is 10% of the electrical conductivity of copper. For example, the copper alloy core 202 may have a % IACS value less than 40%, and the copper plating layer 204 may have a % IACS value greater than 70%.

The material of the core 202 is a copper alloy that includes copper and one or more other metals. Some non-limiting examples of copper alloys that may form the core 202 include a phosphor bronze alloy, a copper nickel silicon alloy, and similar alloys. In one embodiment, the copper plating layer 204 is composed of substantially pure copper. As used herein, "substantially pure copper" includes materials that are 100% copper as well as materials that, due to the presence of trace materials, include at least 95% copper (e.g., by mass or weight), at least 97% copper, or at least 99% copper. In the embodiment in which the copper plating layer 204 is substantially pure copper, the % IACS value may be greater than 95%. In other embodiments, the copper plating layer 204 is a copper alloy includes copper and non-trace amounts of one or more other metals, but the % IACS value is still greater than that of the copper alloy core 202.

The copper plating layer 204 is the outermost conductive layer of the conductor 51. During operation, the electrical current transmitted along the conductor 51 concentrates along the copper plating layer 204 that surrounds the core 202 due to the skin effect phenomenon. Although the protective outer layer 206 surrounds the copper plating layer 204, the electrical current density does not concentrate along the protective outer layer 206 because the protective outer layer 206 is composed of a non-conductive polymeric material.

Some known conductors include a nickel plating layer that surrounds a copper alloy core and defines an outermost layer of the known conductor. Therefore, the electrical current density concentrates along the nickel plating layer in the known conductors. The copper plating layer 204 of the conductors 51 has a greater conductivity than nickel plating layers, which may be less than 30% IACS. Due to the greater conductivity of the outermost conductive layer, the conductors 51 described herein may have a reduced amount of conductor-caused insertion loss during operation than the known conductors with outermost nickel plating layers. The reduced amount of insertion loss may allow an electrical connector with the conductors 51 (e.g., the electrical connector 10 shown in FIG. 1) to provide greater Signal to Noise (SNR) ratio and quality at high signal speeds than an electrical connector with the known conductors.

In the illustrated embodiment, the copper plating layer 204 is disposed directly on an outer surface 208 of the copper alloy core 202. But, in an alternative embodiment, the copper plating layer 204 may be separated from the core 202 by one or more intervening layers. The copper plating layer 204 surrounds the core 202 around a full perimeter of the core 202. The copper plating layer 204 engages the outer surface 208 along the entire perimeter of the core 202. As shown in FIG. 4, there is no portion of the perimeter of the core 202 that is exposed to the environment outside of the copper plating layer 204.

The protective outer layer 206 is disposed directly on an outer surface 210 of the copper plating layer 204 and surrounds the copper plating layer 204. The protective outer layer 206 is composed of a non-conductive polymeric material, such as one or more plastics, epoxies, resins, or the like. In an embodiment, the protective outer layer 206 surrounds the copper plating layer 204 around a full perimeter of the copper plating layer 204. The protective outer layer 206 engages the outer surface 210 along a full perimeter of the copper plating layer 204. As shown in FIG. 4, there is no portion of the perimeter of the copper plating layer 204 that is exposed to the environment outside of the protective outer layer 206. The protective outer layer 206 therefore seals the copper plating layer 204, providing corrosion protection and blocking exposure of the copper plating layer 204 to moisture, debris, and contaminants.

An outer surface 212 of the protective outer layer 206 defines an exterior surface of the conductor 51 along the intermediate segment 104. The protective outer layer 206 is discrete from the dielectric body 52 (shown in FIG. 2) of the electrical connector 10 (FIG. 1). For example, the dielectric body 52 may engage the outer surface 212 of the protective outer layer 206 along the intermediate segment 104 to hold the conductor 51 in place.

FIG. 5 shows a cross-sectional view of the intermediate segment 104 of the conductor 51 according to a second embodiment. The conductor 51 shown in FIG. 5 is similar to the embodiment of the conductor 51 shown in FIG. 4. For example, the conductor 51 in FIG. 5 includes the copper alloy core 202, the copper plating layer 204, and the protective outer layer 206 of the conductor 51 shown in FIG. 4. The conductor 51 in FIG. 5 also includes a nickel plating layer 220, which is absent from the conductor 51 in FIG. 4.

In the illustrated embodiment, the nickel plating layer 220 surrounds the copper alloy core 202. The nickel plating layer 220 is disposed between the core 202 and the copper plating layer 204. The nickel plating layer 220 engages the outer surface 208 of the core 202 and extends around the full perimeter of the core 202. The copper plating layer 204 is disposed directly on an outer surface 222 of the nickel plating layer 220 and surrounds the nickel plating layer 220 around a full perimeter thereof. Similar to the embodiment shown in FIG. 4, the copper plating layer 204 defines the outermost conductive layer in which the electrical current concentrates during operation, and the non-conductive protective outer layer 206 provides corrosion protection for the copper plating layer 204.

Since some known conductors have a copper alloy core similar to the core 202 that is surrounded by a nickel plating layer, the embodiment of the conductor 51 shown in FIG. 5 may be formed using a known conductor as a starting object. The copper plating layer 204 may be applied onto the nickel plating layer, and then the non-conductive protective outer layer 206 may be applied onto the copper plating layer 204.

FIG. 6 shows a cross-sectional view of the intermediate segment 104 of the conductor 51 according to a third embodiment. The conductor 51 in the illustrated embodiment has a copper alloy core 302 that differs from the copper alloy core 202 shown in FIGS. 4 and 5. The copper alloy core 302 has a greater conductivity than the core 202 attributable to a different material composition. For example, the copper alloy core 302 is composed of an alloy that includes iron and phosphorus with copper. The copper alloy core 302 is referred to herein as an iron phosphorus copper core 302. The iron phosphorus copper core 302 optionally may include other metals in addition to copper, iron, and phosphorus. The iron phosphorus copper core 302 has a % IACS value greater than 70%. In one embodiment, the iron phosphorus copper alloy has a measured % IACS value of 85%.

The conductor 51 in the illustrated embodiment includes the non-conductive protective outer layer 206 of the conductors 51 shown in FIGS. 4 and 5. Unlike the embodiments of FIGS. 4 and 5, the protective outer layer 206 is disposed directly on an outer surface 304 of the iron phosphorus copper core 302. Thus, there is no intervening plating layer between the protective outer layer 206 and the core 302. The protective outer layer 206 surrounds the iron phosphorus copper core 302 around a full perimeter thereof, protecting the outer surface 304 from corrosion by blocking exposure to the elements (e.g., moisture, debris, etc.).

The outer surface 304 of the iron phosphorus copper core 302 defines the outermost conductive layer of the conductor 51 in the illustrated embodiment. Due to the skin effect, the electrical current density may concentrate towards the outer surface 304 of the core 302. Since the iron phosphorus copper core 302 has a relatively high conductivity relative to known core materials and nickel plating layers, the core 302 of the conductor 51 may have a reduced amount of conductor-caused insertion loss during operation than known conductors with outermost nickel plating layers.

Figure 7:
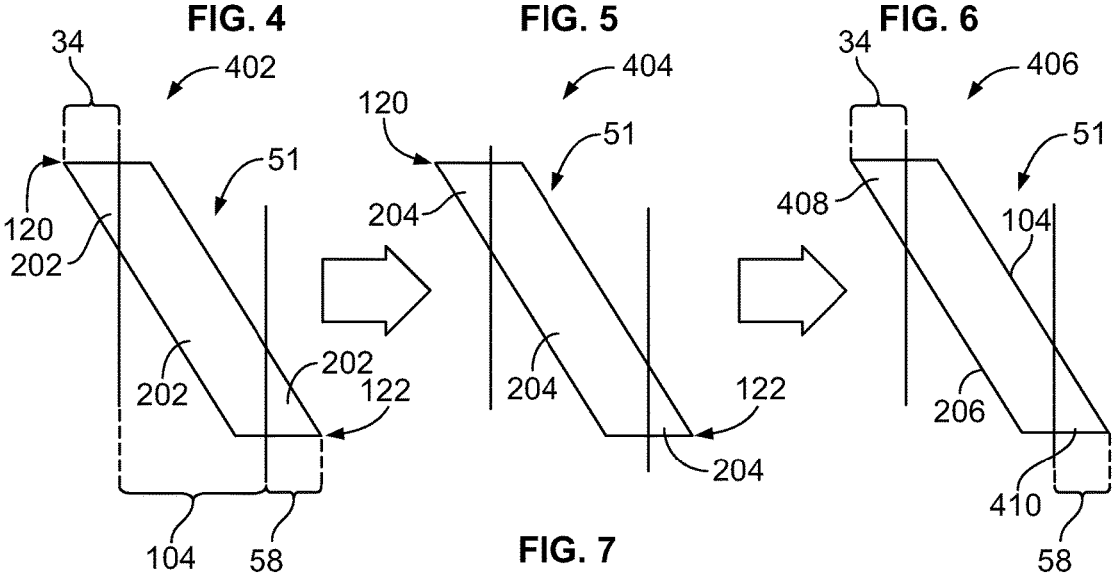
FIG. 7 is a schematic diagram showing a time-lapse process of forming the electrical conductor shown in FIG. 4 according to an embodiment.

FIG. 7 is a schematic diagram showing a time-lapse process of forming the electrical conductor 51 shown in FIG. 4 according to an embodiment. The diagram shows the conductor 51 at a first state 402, at a subsequent second state 404, and at a finished state 406. The schematic diagram segments the conductor 51 into the mating contact portion 34 at the mating end 120, the contact tail 58 at the mounting end 122, and the intermediate segment 104.

The conductor 51 at the first state 402 includes only the copper alloy core 202. The core 202 may be stamped and formed from a sheet of metal or molded. The core 202 extends the entire length of the conductor 51 from the mating end 120 to the mounting end 122. At the second state 404, the copper plating layer 204 is applied on the copper alloy core 202. The copper plating layer 204 surrounds the core 202 along the entire length of the conductor 51 from the mating end 120 to the mounting end 122. Only the copper plating layer 204 is visible in the schematic diagram at the second state 404 because the core 202 is underneath the copper plating layer 204. The copper plating layer 204 may be applied via any plating method, such as electroplating, physical vapor deposition, dipping, painting, sputter deposition, or the like. Since the copper plating layer 204 covers the entire length of the conductor 51, the plating process may be relatively simple without necessitating masking certain portions of the conductor 51.

At the finished state 406, the non-conductive protective outer layer 206 covers the copper plating layer 204 along the intermediate segment 104. The protective outer layer 206 may be applied by spraying, dipping, or painting the non-conductive polymeric material onto the conductor 51 and subsequently curing to solidify the protective outer layer 206. In an embodiment, the protective outer layer 206 is only applied to the intermediate segment 104, and not along either of the contact tail 58 or the mating contact portion 34. For example, the contact tail 58 and the mating contact portion 34 may be masked prior to applying the non-conductive polymeric material to the intermediate segment 104.

In the illustrated embodiment, the copper plating layer 204 along the mating contact portion 34 is selectively spot-plated with a series of mating finishing metals 408. For example, the mating finishing metals 408 may include a palladium layer, a nickel layer, and a gold layer that defines an outermost layer. The mating finishing metals 408 are selected to provide desired electrical properties at the mating interface between the conductor 51 and a mating contact of a mating connector. The mating finishing metals 408 are only applied along the mating contact portion 34.

The copper plating layer 204 along the contact tail 58 is selectively spot-plated with a series of one or more mounting finishing metals 410. For example, the mounting finishing metals 410 may include a nickel layer covered by a tin layer. The mounting finishing metals 410 are selected to provide desired electrical and mechanical properties at the mounting interface between the conductor 51 and a circuit board. The mounting finishing metals 410 are only applied along the contact tail 58.

Figure 8:
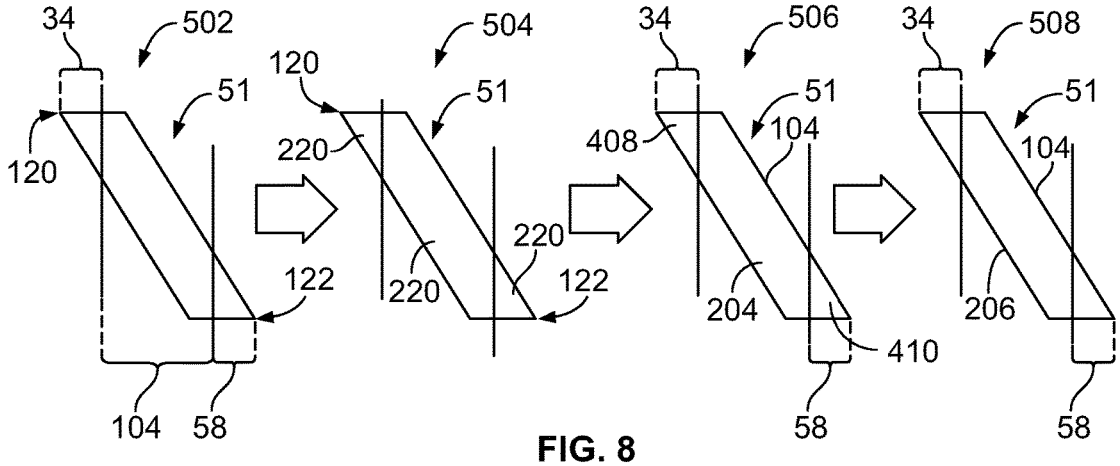
FIG. 8 is a schematic diagram showing a time-lapse process of forming the electrical conductor shown in FIG. 5 according to an embodiment.

FIG. 8 is a schematic diagram showing a time-lapse process of forming the electrical conductor 51 shown in FIG. 5 according to an embodiment. The diagram shows the conductor 51 at a first state 502, at a subsequent second state 504, at a subsequent third state 506, and at a finished state 508. The schematic diagram segments the conductor 51 into the mating contact portion 34 at the mating end 120, the contact tail 58 at the mounting end 122, and the intermediate segment 104.

The conductor 51 at the first state 502 includes only the copper alloy core 202. The conductor 51 at the first state 502 may be identical to the conductor 51 at the first state 402 described in FIG. 7. At the second state 504, the nickel plating layer 220 is applied on the copper alloy core 202. The nickel plating layer 220 surrounds the core 202 along the entire length of the conductor 51 from the mating end 120 to the mounting end 122. Only the nickel plating layer 220 is visible in the schematic diagram at the second state 504 because the core 202 is underneath the nickel plating layer 220. The nickel plating layer 220 may be applied via any plating method, such as electroplating, physical vapor deposition, dipping, painting, sputter deposition, or the like. Since the nickel plating layer 220 covers the entire length of the conductor 51, the plating process may be relatively simple without necessitating masking certain portions of the conductor 51.

The conductor 51 at the third state 506 is selectively plated with different metals along the different lengths of the conductor 51. For example, the copper plating layer 204 is applied along the intermediate segment 104. The copper plating layer 204 optionally is not applied along the mating contact portion 34 or the contact tail 58. Thus, in the illustrated embodiment, the copper plating layer 204 only surrounds the core 202 and the nickel plating layer 220 along the intermediate segment 104. The mating contact portion 34 is selectively spot-plated with the mating finishing metals 408 described with reference to FIG. 7. The contact tail 58 is selectively spot-plated with the mounting finishing metals 410 described with reference to FIG. 7.

The conductor 51 at the finished state 508 includes the non-conductive protective outer layer 206 that covers the copper plating layer 204 along the intermediate segment 104. The protective outer layer 206 may be applied as described with reference to the finished state 406 in FIG. 7. In an embodiment, the protective outer layer 206 is only applied to the intermediate segment 104, and not along either of the contact tail 58 or the mating contact portion 34. The outer appearance of the finished conductor 51 in the illustrated embodiment may be identical to the outer appearance of the finished conductor 51 of FIG. 7.

Referring now back to FIG. 6, the conductor 51 of FIG. 6 may be produced by first forming the copper alloy core 302 to extend between mating and mounting ends. The copper alloy core 302 may be composed of the iron phosphorus copper alloy. Then, the intermediate segment may be masked while the mating contact portion and the contact tail are selectively spot-plated with the finishing metals described above with reference to FIGS. 7 and 8. Last, the non-conductive protective outer layer 206 is applied directly onto the copper alloy core 302 along the intermediate segment only. The outer appearance of the finished conductor 51 of the embodiment shown in FIG. 6 may be identical to the outer appearances of the finished conductors 51 of FIGS. 7 and 8.

Figure 9:
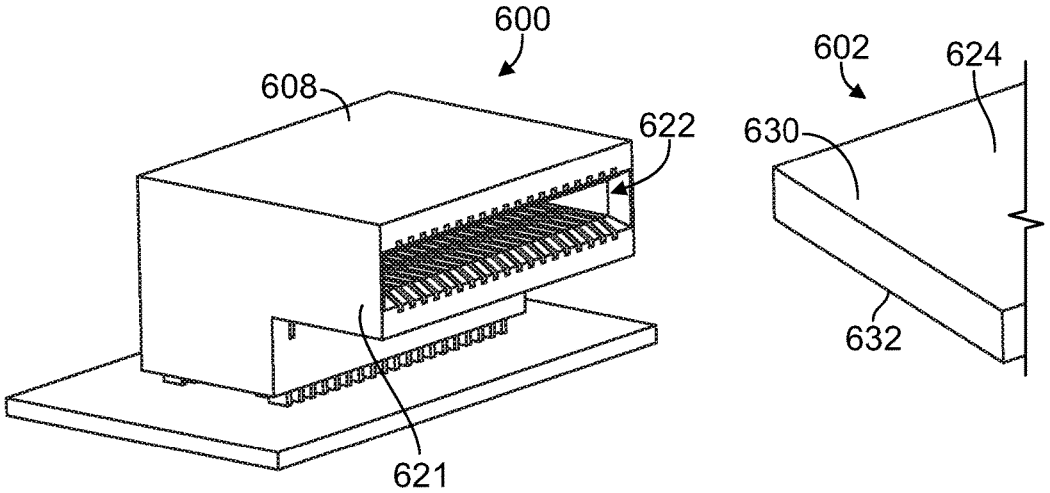
FIG. 9 is a perspective view of an electrical connector and a portion of a mating connector according to another embodiment.
Figure 10:
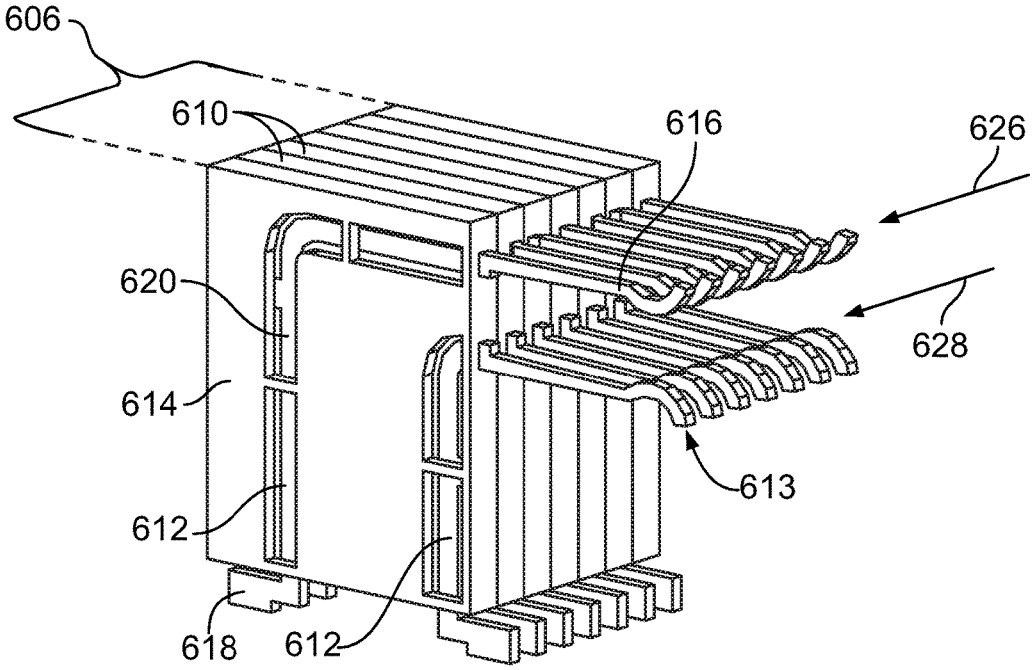
FIG. 10 is a perspective view of a module stack of the electrical connector of FIG. 9 according to an embodiment.

The inventive subject matter described herein may not be limited to a specific type of electrical connector, such as the right angle receptacle-style electrical connector 10 shown in FIG. 1. For example, the conductors according to one or more of the embodiments described herein may have different shapes than the conductors 51 shown in FIGS. 2 and 3. FIG. 9 is a perspective view of an electrical connector 600 and a portion of a mating connector 602 according to another embodiment. FIG. 10 is a perspective view of a module stack 606 of the electrical connector 600 according to an embodiment. The electrical connector 600 includes a housing 608 and the module stack 606. The module stack 606 is held within the housing 608. The module stack 606 includes multiple contact modules 610 that are stacked side-by-side. Each contact module 610 in the illustrated embodiment includes two conductors 612 that are held by a dielectric body 614 of the contact module 610. The two conductors 612 are held in a linear array 613 within the dielectric body 614. The contact modules 610 may have other than two conductors 612 in other embodiments. Like the conductors 51 shown in FIG. 3, the conductors 612 include contact mating portions 616, contact tails 618, and intermediate segments 620 that extend between the contact mating portions 616 and the contact tails 618. The contact mating portions 616 in the illustrated embodiment are spring beams 616. The contact tails 618 are solder tails configured to be surface mounted to a circuit board.

Unlike the electrical connector 10, the housing 608 of the connector 600 includes a mating shroud 621 that defines a card slot 622. The mating connector 602 includes a circuit card 624 that is received within the card slot 622 during a mating operation. The spring beams 616 of the contact modules 610 in the module stack 606 are arranged in a first contact row 626 and a second contact row 628. The first and second rows 626, 628 are held within the mating shroud 621 and extend into the card slot 622. The spring beams 616 in the first contact row 626 are configured to engage contact elements (not shown) along a first side 630 of the circuit card 624, and the spring beams 616 in the second contact row 628 are configured to engage contact elements (not shown) along a second side 632 of the circuit card 624 that is opposite the first side 630. In an embodiment, the conductors 612 are formed according to one of the embodiments of the conductors 51 described herein. For example, the intermediate segments 620 of the conductors 612 may have the same cross-sections as at least one of the embodiments of the conductors 51 shown in FIGS. 4-6.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing; and a plurality of conductors held within the housing and configured to electrically connect to mating conductors of a mating connector, each of the conductors extending a length between a mating end and a mounting end of the respective conductor, one or more of the conductors comprising:

a copper alloy core;

a copper plating layer surrounding the copper alloy core, the copper plating layer composed of a different material than the copper alloy core; and a protective outer layer disposed on and surrounding the copper plating layer, the protective outer layer composed of a non-conductive polymeric material.

2. The electrical connector of claim 1, wherein the copper plating layer has a greater electrical conductivity than the copper alloy core.

3. The electrical connector of claim 1, wherein the copper plating layer is disposed directly on the copper alloy core.

4. The electrical connector of claim 1, wherein each of the one or more conductors includes a nickel plating layer surrounding the copper alloy core and disposed between the copper alloy core and the copper plating layer.

5. The electrical connector of claim 1, wherein the copper plating layer is composed of substantially pure copper.

6. The electrical connector of claim 1, wherein the copper plating layer surrounds the copper alloy core around a full perimeter of the copper alloy core and the protective outer layer surrounds the copper plating layer around a full perimeter of the copper plating layer.

7. The electrical connector of claim 1, wherein the copper plating layer surrounds the copper alloy core along the entire length of the conductor between the mating end and the mounting end.

8. The electrical connector of claim 1, wherein each of the one or more conductors includes a spring beam at the mating end, a contact tail at the mounting end, and an intermediate segment extending from the spring beam to the contact tail, the copper plating layer surrounding the copper alloy core only along the intermediate segment of the conductor.

9. The electrical connector of claim 1, wherein each of the one or more conductors includes a spring beam at the mating end, a contact tail at the mounting end, and an intermediate segment extending from the spring beam to the contact tail, the protective outer layer disposed only along the intermediate segment of the conductor.

10. The electrical connector of claim 1, wherein the conductors are arranged in at least one linear array and secured in place relative to one another by a dielectric body, the dielectric body held within the housing, the dielectric body engaging the protective outer layers of the conductors along intermediate segments of the conductors spaced apart from the mating ends and the mounting ends.

11. An electrical connector comprising:

a housing; and a plurality of conductors held within the housing and configured to electrically connect to mating conductors of a mating connector, the conductors each extending a length between a mating end and a mounting end of the respective conductor, the conductors each including a spring beam at the mating end, a contact tail at the mounting end, and an intermediate segment extending from the spring beam to the contact tail, one or more of the conductors comprising:

a copper alloy core;

a copper plating layer surrounding the copper alloy core, the copper plating layer composed of a different material than the copper alloy core and has a greater electrical conductivity than the copper alloy core; and a protective outer layer disposed on and surrounding the copper plating layer, the protective outer layer composed of a non-conductive polymeric material.

12. The electrical connector of claim 11, wherein each of the one or more conductors includes a nickel plating layer surrounding the copper alloy core and disposed between the copper alloy core and the copper plating layer.

13. The electrical connector of claim 11, wherein the copper plating layer surrounds the copper alloy core along the entire length of the conductor between the mating end and the mounting end.

14. The electrical connector of claim 11, wherein the copper plating layer surrounds the copper alloy core only along the intermediate segment of the conductor.

15. The electrical connector of claim 11, wherein the copper plating layer surrounds the copper alloy core around a full perimeter of the copper alloy core and the protective outer layer surrounds the copper plating layer around a full perimeter of the copper plating layer.

16. An electrical connector comprising:

a housing;

a plurality of conductors held within the housing and configured to electrically connect to mating conductors of a mating connector, the conductors arranged in at least one linear array, the conductors each extending a length between a mating end and a mounting end of the respective conductor, the conductors each including a spring beam at the mating end, a contact tail at the mounting end, and an intermediate segment extending from the spring beam to the contact tail, one or more of the conductors comprising a copper alloy core and a protective outer layer surrounding the copper alloy core around a full perimeter of the copper alloy core, the protective outer layer composed of a non-conductive polymeric material; and a dielectric body held within the housing, the dielectric body encasing the conductors of a common array along the intermediate segments thereof to secure the conductors in place relative to each other, the dielectric body engaging the protective outer layer of the conductors.

17. The electrical connector of claim 16, wherein the copper alloy core is composed of iron, phosphorus, and copper.

18. The electrical connector of claim 16, wherein the protective outer layer is disposed directly on the copper alloy core.

19. The electrical connector of claim 16, wherein each of the one or more conductors includes a copper plating layer surrounding the copper alloy core and disposed between the copper alloy core and the protective outer layer, the copper plating layer composed of a different material than the copper alloy core, the copper plating layer having a greater electrical conductivity than the copper alloy core.

20. The electrical connector of claim 19, wherein each of the one or more conductors includes a nickel plating layer disposed between the copper alloy core and the copper plating layer, the nickel plating layer surrounding the copper alloy core along the entire length of the conductor between the mating end and the mounting end, the copper plating layer and the protective outer layer disposed only along the intermediate segment of the conductor.

* * * * *